US006525644B1

(12) United States Patent
Stillwagon

(10) Patent No.: US 6,525,644 B1
(45) Date of Patent: Feb. 25, 2003

(54) ELECTRO-MECHANICAL LATCH ASSEMBLY

(75) Inventor: Woodrow C. Stillwagon, Atlanta, GA (US)

(73) Assignee: Star Lock Systems, Inc., Hilliard, OH (US)

( * ) Notice: Subject to any disclaimer, the term of this patent is extended or adjusted under 35 U.S.C. 154(b) by 0 days.

(21) Appl. No.: 09/372,525

(22) Filed: Aug. 11, 1999

Related U.S. Application Data

(60) Provisional application No. 60/096,251, filed on Aug. 12, 1998.

(51) Int. Cl.[7] ..... E05B 47/00

(52) U.S. Cl. ..... 340/5.61; 340/5.9

(58) Field of Search ..... 340/825.31, 825.69, 340/825.72, 542, 545, 5.61, 5.9; 292/252, 341.17, 201; 70/278, 231; 361/172; 235/382.5

(56) References Cited

U.S. PATENT DOCUMENTS

| | | | | | |
|---|---|---|---|---|---|
| 1,262,435 | A | | 4/1918 | Berg | |
| 2,727,772 | A | | 12/1955 | Hamilton | 292/144 |
| 3,285,043 | A | | 11/1966 | Dauenbaugh et al. | 70/208 |
| 3,753,316 | A | | 8/1973 | Savarieau et al. | 49/31 |
| 3,911,534 | A | | 10/1975 | Martens et al. | 24/150 |
| 3,919,869 | A | | 11/1975 | Fromm | 70/263 |
| 3,947,930 | A | | 4/1976 | Martens et al. | 24/155 |
| 4,031,434 | A | * | 6/1977 | Perron et al. | 361/172 |
| 4,196,347 | A | | 4/1980 | Hadley | 359/147 |
| 4,207,555 | A | * | 6/1980 | Trombly | 235/382.5 |
| 4,438,962 | A | | 3/1984 | Soloviff et al. | 292/144 |
| 4,663,952 | A | | 5/1987 | Gelhard | 70/278 |
| 4,838,055 | A | | 6/1989 | Gallagher | 70/208 |
| 4,899,561 | A | | 2/1990 | Myers | 70/208 |
| 5,022,243 | A | | 6/1991 | Embry et al. | 70/34 |
| 5,140,317 | A | | 8/1992 | Hyatt, Jr. et al. | 340/825.31 |
| 5,392,025 | A | | 2/1995 | Figh et al. | 340/545 |
| 5,467,619 | A | | 11/1995 | Stillwagon et al. | 70/34 |
| 5,479,799 | A | * | 1/1996 | Kilman | 70/231 |
| 5,575,515 | A | * | 11/1996 | Iwamoto | 292/341.17 |
| 5,602,744 | A | | 2/1997 | Meek et al. | 364/464.22 |
| 5,636,881 | A | | 6/1997 | Stillwagon | 292/150 |
| 5,712,626 | A | | 1/1998 | Andreou et al. | |
| 5,746,458 | A | | 5/1998 | Fisher | 292/252 |
| 5,808,558 | A | | 9/1998 | Meek et al. | 340/870.01 |
| 5,813,257 | A | | 9/1998 | Claghorn et al. | 70/208 |
| 6,005,487 | A | | 12/1999 | Hyatt, Jr. et al. | |
| 6,068,305 | A | * | 5/2000 | Myers | 292/201 |

* cited by examiner

*Primary Examiner*—Edwin C. Holloway, III
(74) *Attorney, Agent, or Firm*—Womble Carlyle Sandridge & Rice, PLLC

(57) ABSTRACT

An electro-mechanical latch assembly for an enclosure such as a vending machine and including an electronic lock controller for disengaging a latch assembly securing the door of the enclosure against the enclosure frame in a closed, locked position. The lock controller is actuated remotely through a key controller to disengage the latch assembly and enable the door of the enclosure to be moved to an open position for accessing the enclosure.

29 Claims, 6 Drawing Sheets

ELECTRO-MECHANICAL LATCH ASSEMBLY

CROSS REFERENCE TO RELATED APPLICATION

This application claims priority to U.S. Provisional Application Serial No. 60/096,251, filed Aug. 12, 1998.

TECHNICAL FIELD

The present invention relates generally to latching and locking devices. In preferred embodiments, the present invention more specifically relates to electronic latching and locking devices such as for use with vending machines and similar enclosures.

BACKGROUND OF THE INVENTION

Latching or locking devices commonly are used to hold lids, doors or other closure elements of boxes, cabinets, doorways and other framed structures in closed and/or locked positions, and further typically are used to provide some measure of security against unauthorized or inadvertent access. For example, conventional vending machines generally include a key operated latch or locking device that typically includes a latching assembly and a post mounted to the frame and door of the vending machine so that the door of the vending machine is automatically locked when moved into a closed position against the machine frame by the insertion of the post into the latching assembly. Such latching assemblies further typically include a housing that defines an axial passage in which the post, often attached to and/or operating in conjunction with a T-handle, is received and is engaged by latch elements that are biased into contact with a surface of the post. The latch elements grip the post and preclude its withdrawal from the axial passage of the latch housing.

Typically, to disengage the latching assembly from the post, these latching assemblies utilize key locks in which a key is received, and, as the key is turned, the biased latching elements of the assembly are released from engagement with the post to enable the door or other closure element to which the latch is mounted to be opened. Examples of such latching assemblies for use with vending machines or similar enclosures are disclosed in U.S. Pat. Nos. 5,050,413, 5,022,243 and 5,467,619. Such an unlocking or opening operation generally is a substantially manual operation such that most latching assemblies generally are limited in their placement to regions or areas where they can be readily reached and operated, i.e., in the middle of the door. Such easy access to these latching assemblies, however, tends to make these latching assemblies easy targets for vandals or thieves can shield their actions from view while attacking the security of the enclosure by picking or smashing the lock to remove the primary and sometimes only point of security between the door and the frame of the enclosure.

In particular, vending machines have become an increasingly favorite target of vandals and thieves. The popularity of vending machines has greatly increased in recent years, especially in remote areas for providing ready access to an increasing variety of goods including food and drinks, stamps, and higher priced items such as toys and cameras, all without requiring human intervention. At the same time, the capacities of conventional vending machines have increased significantly so as to not only provide consumers with more choices, thus creating more opportunities for sales, but further to decrease the amount of servicing or restocking that is required for the vending machines. For example, the typical soft drink vending machine has increased in capacity from approximately 420 cans to approximately 800 cans. The increased popularity and increased capacity of vending machines as well as the expansion of products to higher priced items have significantly increased the amounts of money taken in by vending machines, providing an increasingly attractive target to thieves and vandals. Further, if the key to one of these latching assemblies or locking devices is lost or stolen, all the locks accessible by such key must be "re-keyed" to maintain controlled access and security. Such re-keying is typically burdensome and very costly, especially where there are a significant number of locks that need to be re-keyed. Accordingly there is an increasing interest in improving the security of latching and locking assemblies for securing the doors or other closure devices of vending machines and similar enclosures.

There also exists a problem of monitoring and auditing the amount of time required for a service technician to access and service devices such as vending machines, automatic teller machines, gambling machines or other automated kiosks or containers. It is therefore difficult for many companies to develop a good schedule or concept of the total time required to service such vending devices or machinery to better plan service routes and/or allocate or assign service technicians. This problem is further compounded by conventional latching systems that require the post of the latch to be rotated through multiple revolutions to fully release it from the latch assembly. Such additional time required to disengage and open the latching assembly may seem small per individual machine, but constitutes a significant expenditure of time that can be burdensome, for example, for a company that has a large number of vending machines that must be serviced, by significantly increasing the amount of time required to service each particular vending machine.

There is, therefore, a need for improved latching systems and methods that address these and other related and unrelated problems.

SUMMARY OF THE INVENTION

Briefly described, the present invention generally comprises an electro-mechanical latch assembly or system for securing a door or other closure device for enclosures such as vending machines, trailers, etc. The latching apparatus of the present invention is designed to provide enhanced security for the enclosure and to additionally provide for data collection and transfer of information to enable more accurate tracking of stocking information and service time. Typically, the enclosure to which the electro-mechanical latch assembly of the present invention is applied will include an enclosure frame and at least one door hingedly attached to the enclosure frame so as to be movable between an unlocked, open position displaced from the enclosure frame and a closed, locked position secured against the enclosure frame.

The electro-mechanical latch assembly generally includes a mechanical locking assembly and an electronic lock control system or mechanism. The mechanical lock assembly secures the door against the enclosure frame and is disengaged or actuated remotely through the electronic lock control system.

The electronic lock control system or assembly is generally mounted on the inside of the outer door of the enclosure and controls the operation of a solenoid for disengaging or releasing the mechanical locking assembly from its locked condition to enable unlocking and thus opening of the door of the enclosure. The electronic lock control system generally includes an electronic lock controller and a data/power link or transceiver mounted to the front of the door. Typically, the lock controller includes a microprocessor and memory for storing data or information such as when and how long the door has been opened and by whom, a capacitor and a relay switch. The data/power link typically comprises an inductive coupling such as ferrite coil which enables indirect, inductive power transfer through the door over a desired air gap. A data transfer thereafter is accomplished through electromagnetic dynamics, radio frequency transfer or an infrared link. The data/power link is connected to the electronic controller for providing a transfer of power and data to the electronic lock controller.

A hand held key controller provides power and data signals and commands to the electronic lock controller via the data/power link mounted to the door. The key controller typically will have a mating data/power link, i.e., inductive ferrite coil, a power supply such as a battery, and typically includes a display such as a touch screen or a LCD screen and key-pad for entry and review of data to be transferred to and received from the electronic lock controller. As the key controller is actuated, it sends power and data signals through the door to the data power link and to the lock controller to power the controller and identify the key controller. Upon verification of the key controller personal identification number (PIN) and that the key controller is authorized to access the enclosure, programming updates and/or other data are transferred between the key controller and the lock controller. Thereafter, the lock controller sends a signal or pulse to an actuator for the mechanical locking assembly to energize and cause the locking assembly to disengage and allow the user or operator to unlock and open the door.

The mechanical locking assembly can include a conventional T-handle assembly or post latching system. The mechanical locking assembly is actuated by the electronic lock controller and generally includes an inner lock housing mounted to the enclosure frame and having an axial passage formed therethrough into which a series of teeth or lock elements project. A post assembly is mounted to the door opposite the latch housing. The post assembly includes an outer lock housing mounted to and projecting through the door, and a handle portion received within the outer lock housing. An elongated post or shaft is slidably mounted to the handle at its proximal end and includes a series of teeth formed about its distal end. The teeth formed about the distal end of the post are adapted to engage the teeth or latch elements of the inner lock housing to secure the post to the inner lock housing when the door is in its closed and locked position.

The handle generally includes a handle body received within the outer lock housing and having an open-ended passage formed at its other end in which the proximal end of the post or shaft is received. A locking element or bolt is positioned along the handle body and is biased outwardly from the handle body. The bolt projects through and engages the outer lock housing when the handle is in a depressed, locked position with the door secured against the enclosure frame. An actuator is mounted adjacent the outer lock housing and typically includes a solenoid and a pivoting lever or plate. As the solenoid is actuated, the lever engages and urges the lock bolt downwardly and out of engagement with the outer lock housing to release the handle and enable the post to be disengaged from the inner lock housing to release and enable the door to be moved to its unlocked position spaced from the enclosure frame.

After the operator performs the desired tasks/operations for the enclosure, the operator enters any additional data or programming information such as repair or work orders for the machine or stocking information into the key controller and thereafter closes and locks the door. The information stored in the key controller, such as the amount of stock input into a certain vending machine or machines, the service time required to service a machine, or a repair order, will be downloaded from the key controller to a central server or computer at the operator's plant or base of operations for generation of reports and analysis of service data. The key controller further can be reprogrammed with new or additional route information, including a different PIN or identification numbers or other programming information as well as charging of the power source for the key controller.

Various objects, features and advantages of the present invention will become apparent to those skilled in the art upon reading the following detailed description, when taken in conjunction with the accompanying drawings.

DETAILED DESCRIPTION OF THE PREFERRED EMBODIMENTS

Figure 1:
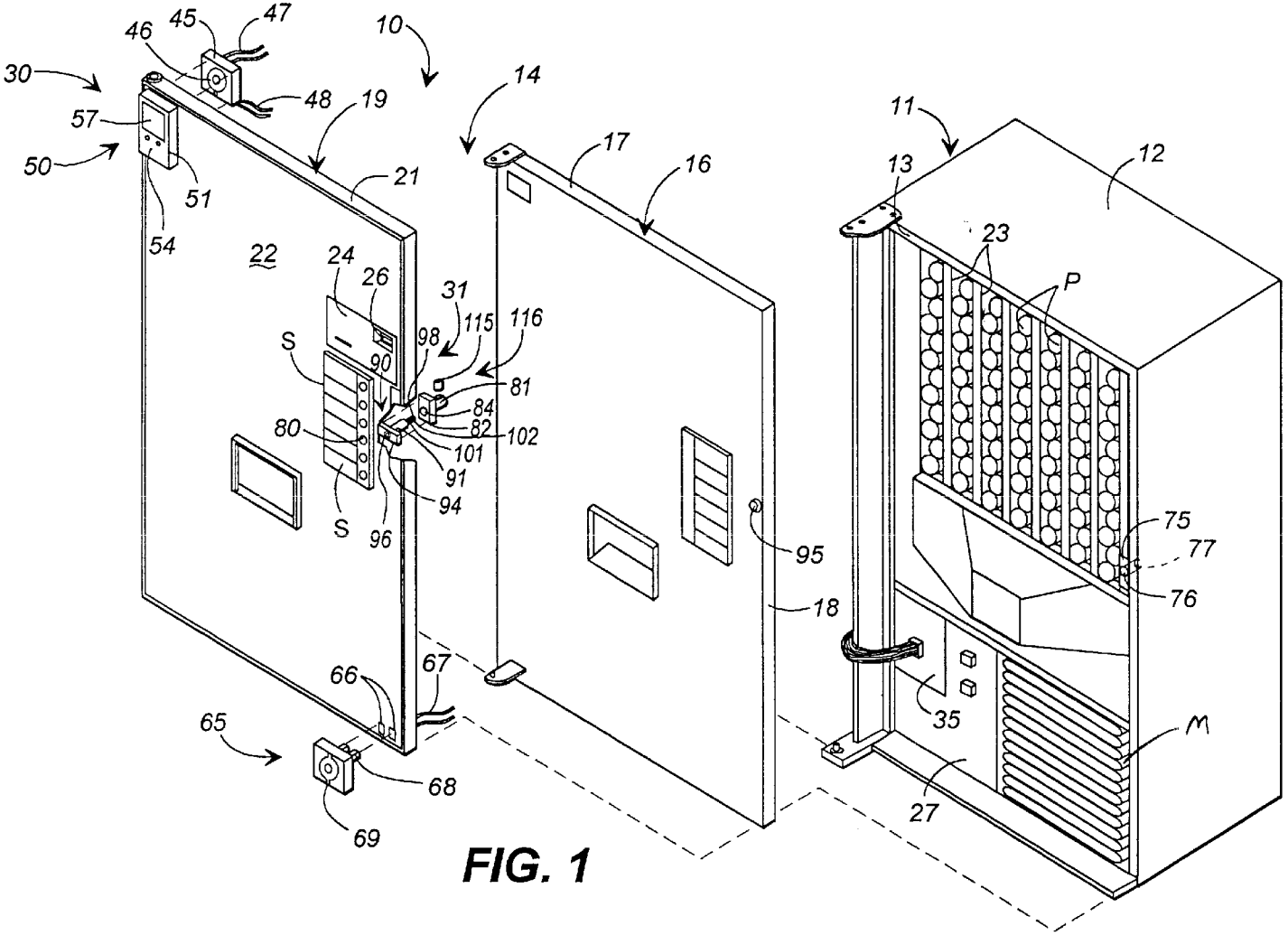
FIG. 1 is an exploded perspective view of the present invention of an electro-mechanical latch assembly as applied to a vending machine in an exemplary embodiment.
Figure 3:
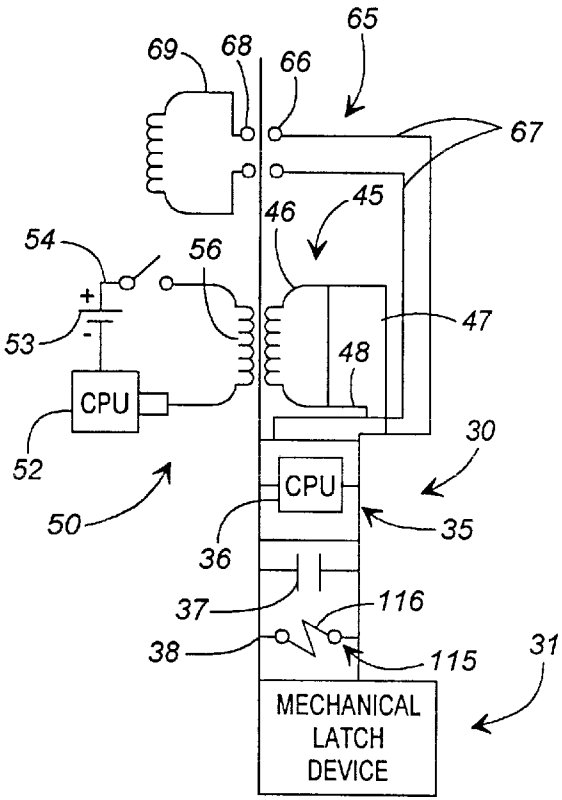
FIG. 3 is a schematic illustration of the circuit for operation of the lock control assembly of the present invention.
Figure 2:
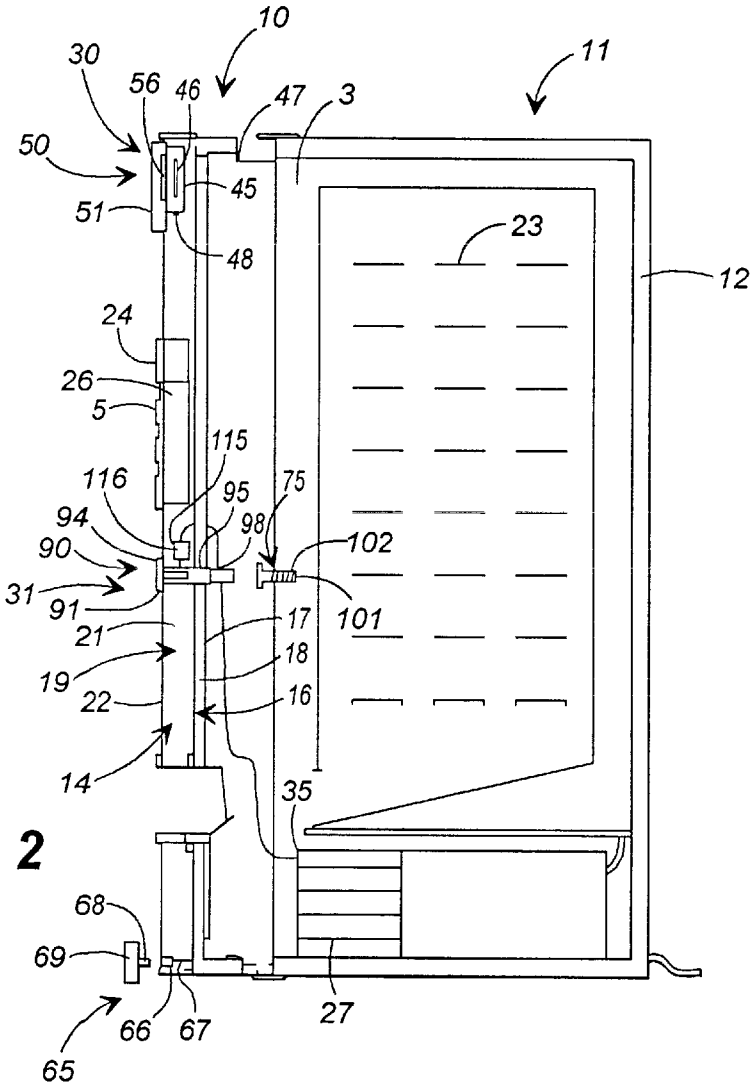
FIG. 2 is a side elevational view taken in partial cross section of the electro-mechanical latch assembly of FIG. 1.

Referring now to the drawings in greater detail in which like numerals indicate like parts throughout the several views, FIGS. 1–3 illustrate an electro-mechanical latch or locking assembly 10 for locking or securing and thus restricting access to an enclosure, as illustrated at 11 in FIG. 1, and which further enables recording and transfer of information and data between a control system for the enclosure and an operator key or control unit, such as who accessed the enclosure and at what times, and stocking data, etc. The enclosure 11 is generally illustrated in FIG. 1 as a vending machine such as a soft drink machine, for purposes of illustration. It will, however, be understood by those skilled in the art that the electro-mechanical latch assembly 10 of the present invention can be applied to various types of enclosures including vending machines, automated teller machines, cabinets, storage units and other, similar types of enclosures.

Typically, the enclosure 11 will include a cabinet or body 12, frame 13 and a door assembly 14 hingedly attached to the frame so as to be movable between an unlocked, open position and a locked, closed position secured against the enclosure frame. In the case of a vending machine, as illustrated in FIG. 1, the door assembly typically will include an inner door 16, which typically comprises an insulating barrier formed from an insulating foam material and having an outer frame 17 with a sealing gasket 18 formed from a flexible sealing material applied thereabout, and an outer door 19 which includes an outer frame 21 surrounding a door panel 22 that is formed from a somewhat translucent, durable plastic material such as LEXAN® and typically is imprinted with a design such as a product design or name, or which can be substantially transparent to enable viewing of the product contained within the enclosure. It will also be understood that a single door assembly, comprising a single door with spaced front and rear panels and a door frame, also can be used in place of the multiple door assembly illustrated in FIGS. 1 and 2. Further, in the case of a vending machine, the machine/enclosure generally will include product racks 23 for storing and supporting products P, such as soft drinks or other food items, a motor M for selecting and dispensing the products, a selector pad assembly S through which users can input desired product selections, and a coin or money reader 24 with a cash box 26 (FIG. 2) for receipt of monies for the selected products. The enclosure also typically will include a machine control 27 (FIG. 1) connected to an external power source, for processing user product requests and controlling the dispensing of products from the machine/enclosure.

The electro-mechanical latch assembly 10 generally includes an electronic lock control system 30 mounted to the outer door 19 and a mechanical locking assembly 31 mounted to the outer door 17 and frame 13 of the enclosure 11, as illustrated in FIGS. 1 and 2, for securing the doors in their locked position against the frame. The electronic lock control system communicates with and actuates or controls the mechanical locking assembly 31 for actuating or disengaging the locking assembly 31 to enable the inner and outer doors to be released and moved from their locked position against the frame 13 to their unlocked, open position for access to the enclosure cabinet.

As illustrated in FIGS. 1–3, the electronic lock control system 30 generally includes an electronic lock controller 35 typically mounted inside the enclosure 11 (FIGS. 1 and 2). The lock controller 35 generally includes a processor 36 (FIG. 3) such as a 64 to 128 bit microprocessor chip or board having internal memory and a clock, a capacitor 37 for storing power and generating a 40–50 volt DC pulse for activation of an actuator 115 of the locking assembly 31, and a relay 38 for transmitting power to and triggering the actuator. The lock controller generally is not directly connected to a direct power source such as a power outlet as is the machine controller 27 (FIG. 1), but instead is designed to receive and be powered from an indirect power source. The lock controller communicates with the machine controller to transmit program updates and other information to the machine controller and receives data or information from the machine controller as to the operation of the enclosure such as a vending machine.

A data/power link 45 is connected to the lock controller for supplying power and control signals/instructions to and transmitting data from the lock controller. The data/power link generally includes an inductive coupling 46 such as a ferrite coil, typically 40–50 mm in diameter by approximately 25–30 mm in thickness, such as manufactured by MAGNETICS®. In addition, the data/power link includes a transceiver for receiving and sending data signals by electromagnetic dynamics or could include a radio frequency (RF) link or transceiver, or an infrared link, primarily for use with a substantially transparent outer door panel. The data/power link is mounted on the rear surface of the outer door 19 as shown in FIG. 1, typically positioned in the upper left hand corner adjacent the door frame 21, and facing outwardly so as to position the data/power link in a fixed location for ease of locating. The data/power link 45 generally includes two sets of leads 47 and 48 that are connected to the lock controller 35. One set of leads 47 transmits power received through the data/power link to the lock controller, while the other set of leads 48 transmits data received through the data/power link to the lock controller.

Figure 5A:
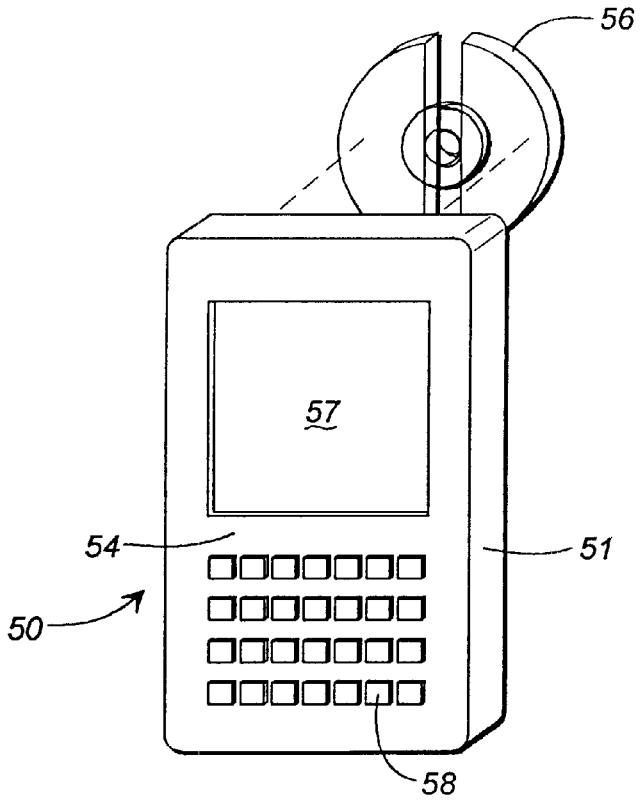
FIG. 5A is a perspective illustration of a first embodiment of the key controller.
Figure 5B:
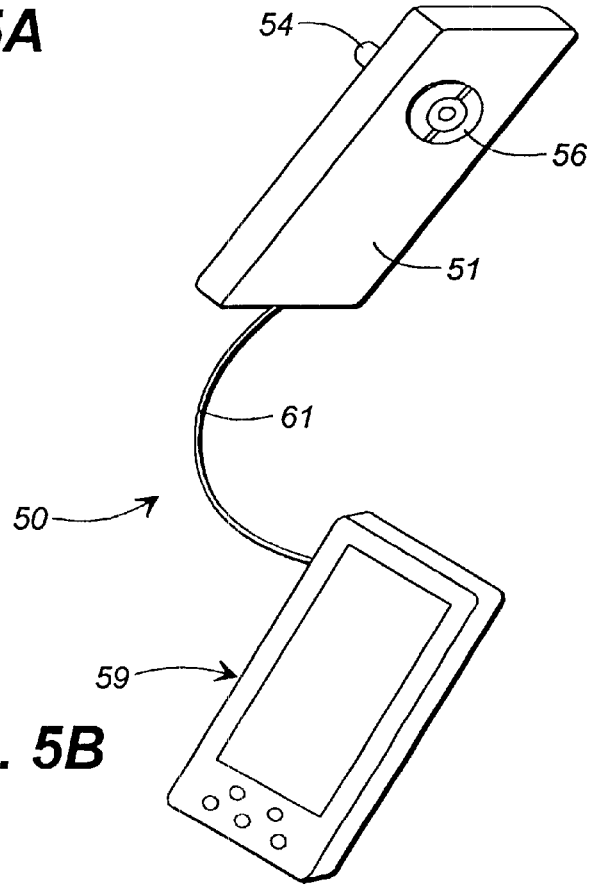
FIG. 5B is a perspective illustration illustrating a second embodiment of the key controller.

A key controller 50 is provided for inductively transmitting power and control instructions or signals through the door(s) of the enclosure to the lock controller via the data/power link and for receiving data and operational information from the lock controller. The key controller 50 (FIG. 3) typically is a hand held unit which includes a housing 51, a processor chip 52 such as a 64 to 128 bit microprocessor, a power source 53 such as a 9 volt battery that typically is rechargable or which enables a connection to an AC outlet or other external power source, a switch 54, and an inductive coupling or link 56 that matches the inductive coupling of the data/power link. For example, if the data/power link includes a ferrite coil inductive coupling 46, the key controller typically will include a matching ferrite coil. The key controller is aligned with the data/power link and transmits power inductively through the front panel of the outer door of the enclosure through inductive transfer to the data/power link and thus to the lock controller. Thereafter, once the data/power link has been energized by the inductive power transfer, data is transferred between the key controller and data/power link through electromagnetic dynamics, or, if an RF or infrared link is used, through radio frequency or infrared signals, to indirectly power and communicate with and/or program the lock controller. As illustrated in FIGS. 1 and 5A, the key controller further includes a display 57 through which programming and data/information received from the lock controller can be reviewed by an operator. The key controller also generally includes an input mechanism such as a key pad 58 (FIG. 5A) or can use a touch screen for the display 57. Further, as illustrated in FIG. 5B, the key controller can include a connection to a hand held PC, used in place of the touch screen and key pad for the controller 59, such as a PALM PILOT® or similar hand held personal computing unit, and connected to the key controller by a lead or connection 61.

Figure 6A:
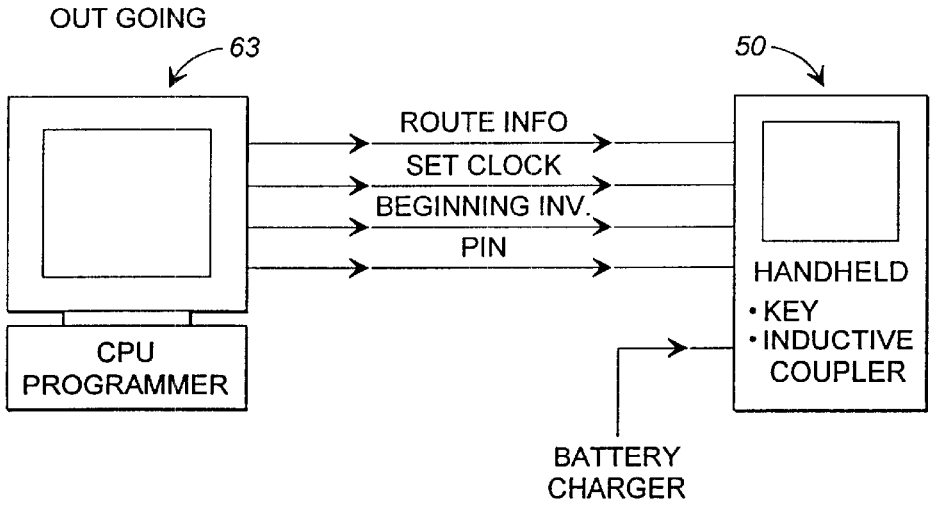
FIG. 6A is a schematic illustration of the programming of the key controller.
Figure 6B:
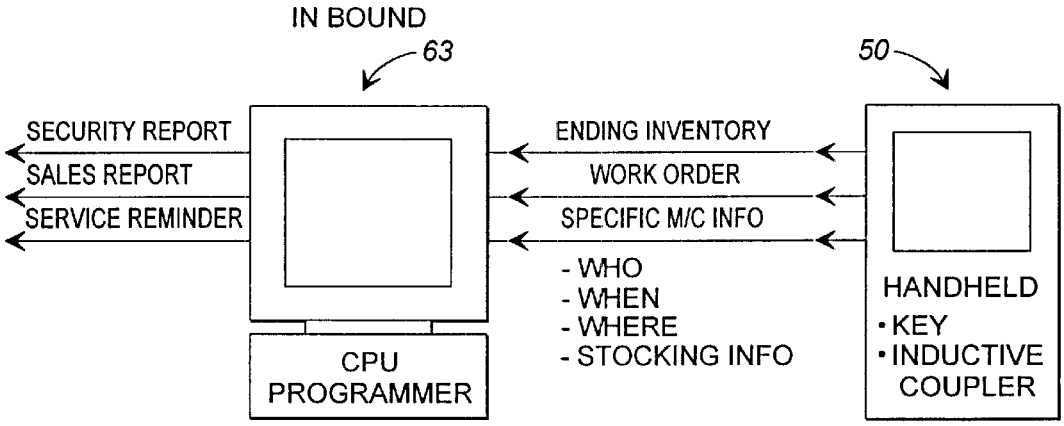
FIG. 6B is a schematic illustration of the downloading of information from the key controller to a central processor or server for the preparation of reports.

The hand-held key controller unit typically is programmed through a central processing unit or server computer 63 (FIG. 6A) at the operator's base of operations. The key controller is typically programmed with data/information such as route information and a personal identification number or code that can be set to authorize access to only certain types or groups of vending machines, and its internal clock is set to match the internal clock of the lock controller of the machines/enclosures to be accessed by the key controller as indicated in FIG. 6A. In addition, the key controller typically is programmed with program instructions for downloading to the lock and machine controllers during accessing of the lock controllers. For example, program instructions can be included in the key controller to set operating times for a vending machine such that the machine will only allow access and operation for dispensing products during a certain prescribed time interval such as during school lunch hours for vending machines located at school cafeterias. The internal power source, i.e., battery, of the key controller also is typically fully charged and can be reprogrammed on a regular basis such as on a daily or weekly basis as needed. As indicated in FIG. 6B information received and stored in the key controller from the machines accessed thereby also generally will be downloaded to the server 63 from the key controller for generating reports and monitoring the servicing of the machines.

In addition, a secondary or back door control access 65 typically is provided adjacent a lower edge of the door assembly. The secondary or back door control access generally includes a pair of connectors (66 FIG. 1) mounted to the outer door 19 of the door assembly 14 and which are connected to the lock controller via leads 67. The connectors typically are female connectors that receive mating male connector leads 68 from a spare inductive coil or power link 69 as illustrated in FIG. 3 to transmit power to the key controller and to the lock controller 35. If the primary data/power link 45 malfunctions or becomes disengaged from the inner door and thus it is not possible to transmit power and data signals to the lock controller through data/power link 45, the spare power link can be connected to the lock controller via the connectors and leads of the secondary or back door control access to providing power to the lock controller for actuation of the solenoid of the mechanical locking assembly to cause the release of the mechanical locking assembly and enable opening of the door assembly for the enclosure.

Figure 4:
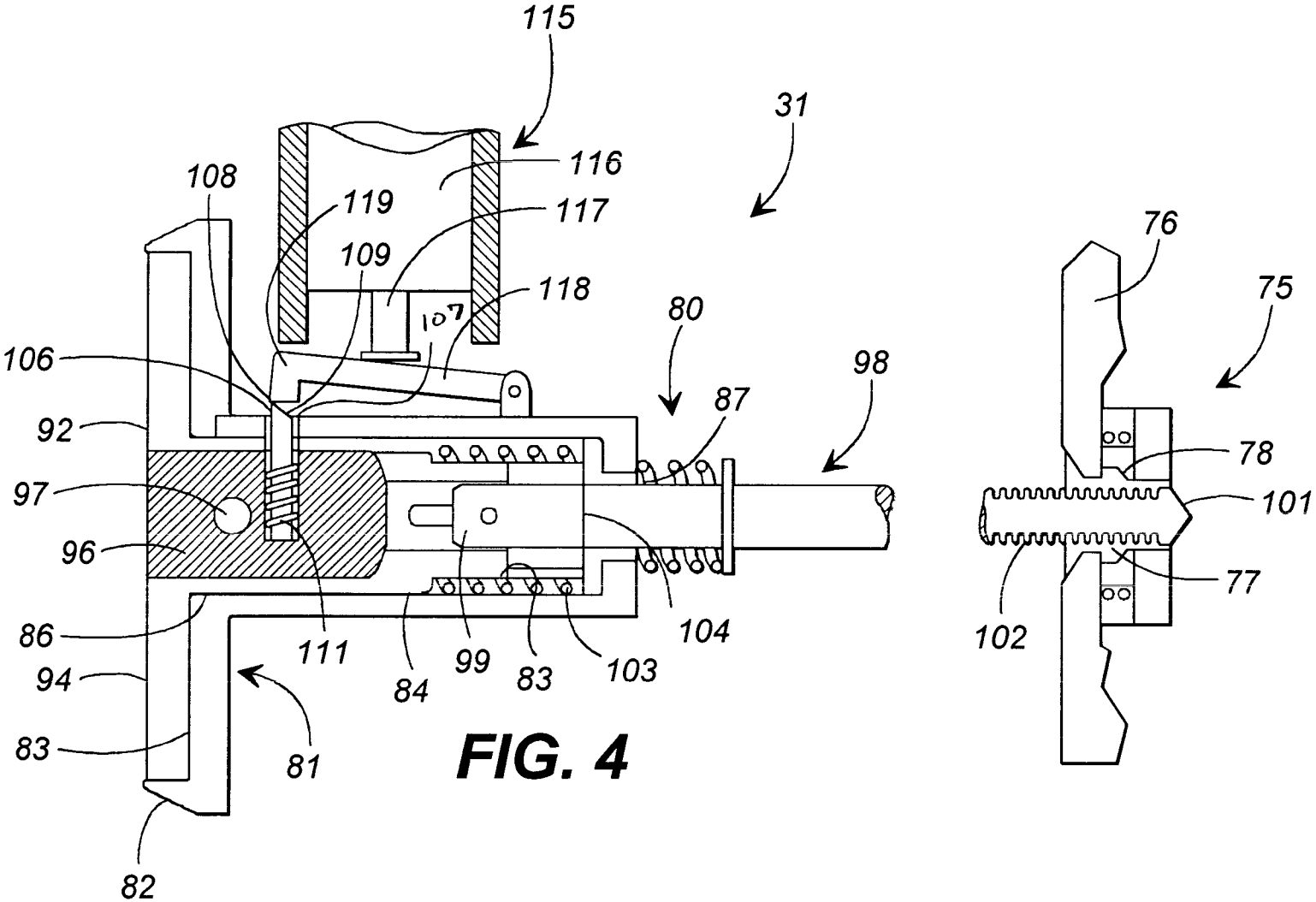
FIG. 4 is a side elevational view of a mechanical locking assembly with solenoid actuator for use as part of the electro-mechanical latch assembly.

The mechanical locking assembly generally 31 can include a conventional T-handle assembly, as illustrated in FIG. 4, or can include a post latching system or other similar types of mechanical locking or latching apparatus as conventionally known and used with vending machines and similar types of enclosures. For purposes of illustration, a T-handle locking assembly is shown for use in the electromechanical latch assembly 10 (FIGS. 1 and 3) of the present invention.

As illustrated in FIG. 4, the mechanical locking assembly 31 includes a first or inner lock housing 75 mounted to the frame 13 of the enclosure and including a mounting plate 76 that is secured to the enclosure frame. An axial passage 77 is formed through the mounting plate and a series of lock elements 78 are positioned along and project into the axial passage. A post assembly 80 is mounted to the outer door 19 (FIGS. 1 and 3) opposite the first or inner lock housing 75 in a position to engage the inner latch housing when the inner and outer doors are moved to their closed position against the enclosure frame. The post assembly 80 generally includes an outer lock housing 81 mounted to the outer door 19 of the enclosure 11 (FIG. 1) and projecting therethrough. The outer housing generally includes a front plate 82 having a recessed area 83 formed therein. An open ended cavity or passage 84 is formed within the outer lock housing and includes a first open end 86 formed in the front plate 82 and a second open end 87 having a narrowed diameter formed at the rear end of the outer lock housing 81 as shown in FIG. 4.

A handle assembly 90 is received within the open cavity 84 of the outer lock housing 81. The handle assembly can be formed using an existing conventional T-handle assembly for a vending machine or enclosure, including a handle body 91 having a first or front end 92 and a second or rear end 93 and which is received within and extends along the opened ended cavity 84 and through a lock opening 95 (FIG. 1) formed in the inner door 16, and a grip portion 94 (FIG. 4) formed at the front end 92 of the handle body for enabling the handle body to be gripped and rotated by a user. With the present invention, the key lock generally used with conventional T-handle locking assemblies generally is removed and a substantially solid plug or core 96 is inserted into the handle body in place of the lock. As FIG. 4 illustrates, the plug typically further includes anti-drill pins 97 positioned vertically and horizontally to prevent vandals, thieves, etc. from drilling through the handle body to break or disengage the mechanical latch assembly.

An elongated post or shaft 98 is mounted to the rear end 93 of the handle body 91 and projects through the second open end 81 of the outer latch housing 81 and is received through the opening 90 (FIG. 1) in the inner door. The post generally includes a proximal or first end 99 (FIG. 4) that is slidably mounted to the second end 93 of the handle body 91 so that the post is longitudinally movable with respect to the handle body, and a second or distal end 101 that extends away from the outer latch housing. A series of teeth or threads 102 are formed about the distal end 101 of the post 98 and engage the lock elements 78 of the inner lock housing 75 as the post is received within and rotated about the axial passage 77 thereof so as to lock the post within the axial passage to lock and secure the inner and outer doors against the enclosure frame.

A compression spring 103 or similar biasing element, is received about the proximal end 99 of the post 98, positioned within the open cavity 84 of the outer lock housing. The compression spring is engaged between the rear end 93 of the handle body and a thrust washer 104 mounted about the post 98 as illustrated in FIG. 4. The compression spring tends to urge the handle body longitudinally out of the outer lock housing to maintain the handle body in an extended, nonengaging, unlocked position until the post has been fully secured within the inner lock housing and the handle is depressed into and engaging, locked position with the grip portion 94 of the handle assembly being received within the recessed area 83 of the outer lock housing.

A locking element or bolt 106 is positioned along the handle body and projects upwardly therefrom through an opening 107 formed in the outer lock housing 41. The locking bolt generally is formed from a metal such as steel and includes an upper end 108 having a beveled or sloped portion 109 adapted to engage the upper edge of the open ended cavity of the outer lock housing as the handle body is moved therealong. A biasing element 111 such as a compression spring is positioned adjacent or received about the locking bolt and urges the locking bolt upwardly toward a raised, engaging position extending through the opening 107 formed in the outer lock housing as illustrated in FIG. 4. With the locking bolt in its raised position extending through opening 107, the handle body is locked in its depressed, engaging position against the outer door of the enclosure.

An actuator 115 is mounted on the rear surface of the panel 22 (FIG. 1) of the outer door 19 of the enclosure adjacent the outer lock housing for disengaging the locking bolt 106 (FIG. 4) from the outer lock housing to release the handle body to enable operation/rotation of the handle assembly for unlocking of the doors. The actuator typically includes a solenoid 116, typically is a 24 volt solenoid having an approximately 0.9 ohm resistance, and which includes a plunger 117 that is extended and retracted by the solenoid upon actuation and deactivation of the solenoid. A pivoting lever 118 is mounted to the outer lock housing and includes a downwardly projecting portion 119 that engages the upper end 108 of the locking bolt 106 as the lever 118 is pivoted downwardly.

As the solenoid is actuated, the plunger 117 is extended and causes the lever 118 to pivot downwardly so that its projection 119 engages and urges the locking bolt 106 downwardly through the opening 107 formed in the outer latch housing so as to move the locking bolt out of its engaging position to release the handle assembly from the outer lock housing. Once the locking bolt has been moved out of engagement with the outer lock housing, the compression spring 103 within the open ended cavity of the outer lock housing urges the handle body outwardly so as to move the grip portion of the handle assembly out of the recessed area 83 of the outer lock housing to enable the handle assembly to be gripped and rotated for rotation of the post to remove the post from locking engagement with the axial passage of the inner lock housing. As the distal end of the post is disengaged from the axial passage of the inner latch housing, the inner and outer doors are released from their locked, engaging position against the enclosure frame and thereafter can be moved to their open position displaced from the enclosure frame to enable access to the interior cabinet of the enclosure.

OPERATION

Figure 7:
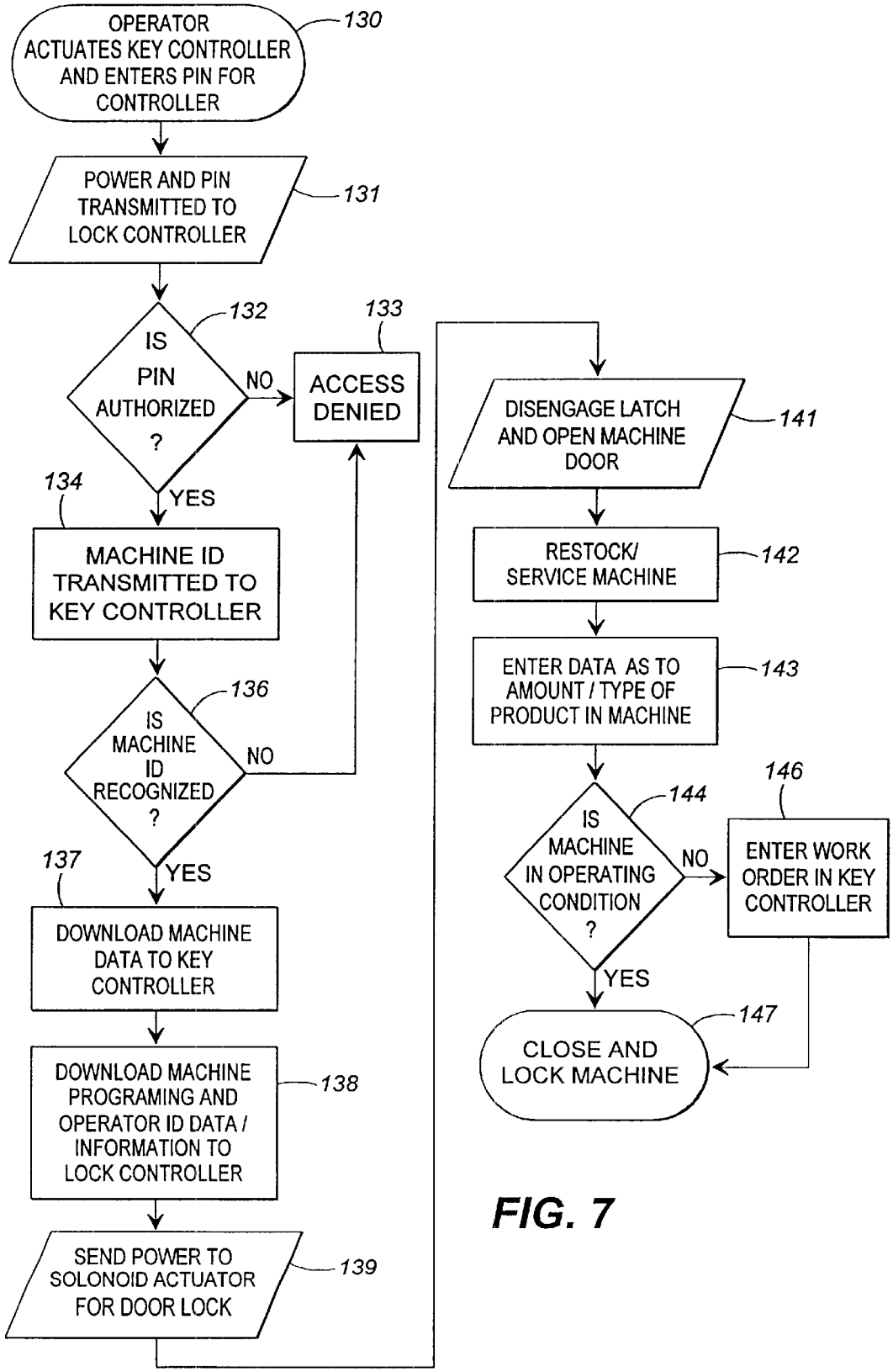
FIG. 7 is a flow chart illustrating the operation of the electro-mechanical latch assembly of the present invention.

The operation of the electronically operated latching assembly 10 is generally illustrated in FIGS. 6A–7. As shown in FIG. 6A, prior to use, the key controller is initially programmed from a central processor or server computer 63 with information including route information identifying a particular set of machines to be accessed by the key controller, identifying the beginning inventory of products being sent out with the service technician or operator, setting the clock within the key controller, to match that of the lock controllers of the machines to be accessed and programming the key controller with a personal identification number (PIN) for accessing the desired machines. In addition, any necessary programming updates for the machines to be accessed also generally are programmed into the key controller. The battery or other power source of the key controller further is fully charged as illustrated in FIG. 6A. Once the key controller 50 has been fully programmed and its battery charged, the user or service technician is able to access a desired series of machines or enclosures for restocking and servicing.

As illustrated in FIG. 1, for operation of the electronically operated latching assembly for opening a desired machine or enclosure, the user first places the key controller on the outer door 19 of the door assembly 14 of the enclosure 11 in registry with the data/power link 45 mounted to the rear surface of the panel 22 of the outer door 19 adjacent a comer of the frame 17 of outer door 19. Typically, the data/power link will be positioned at a comer of the door frame so that the key controller can be slid into the comer and into engagement with the outer door frame 21 to automatically locate and place the inductive coupling or link of the key controller 50 in registry with the inductive coupling of the data/power link 45. It is also possible to provide indicators on the front panel 22 of the outer door 19 for aiding the locating of the key controller in registry with the data/power link and allow the data/power link to be positioned at various points about the inner door as desired. Once the key controller is properly positioned opposite the data/power link 45, the operator, such as a service technician or "route-man", can initiate an opening or unlocking operation as illustration in FIG. 7.

As shown in FIG. 7, as a first operational step 130, the operator actuates the key controller by closing the switch 54 (FIG. 3) and, if necessary, enters the personal identification number for the controller through the key pad and display 58 and 57 (FIG. 5A). Upon actuation of the key controller, power from the battery of the key controller is transmitted inductively through the door across an air gap to the mating data/power link and to the lock controller to energize the data/power link and lock controller, after which the PIN of the key controller is transmitted through the data/power link to the lock controller as illustrated in step 131. The lock controller in step 132 checks the PIN number of the key controller against a programmed list or set of authorized PIN numbers stored within the memory of the lock controller. If the PIN number is not found to be an authorized identification number, access is denied as indicated at 133. If the PIN number is recognized as being an authorized identification number, the particular machine identification is transmitted to the key controller as indicated at 134. The key controller then checks to see if the machine is a recognized machine that is to be accessed during this particular service call by the key controller, as illustrated at 136 and if not, access to the machine is denied.

If the machine ID is recognized as a machine that is to be accessed during the particular service call, a response signal is sent to the lock controller verifying the machine ID and in turn the lock controller downloads data concerning the operation of the machine, such as the time and dates that the machine has been accessed and by whom as well as potential fault conditions detected by the machine controller as shown in step 137. Thereafter, in step 138 the key controller downloads machine programming and operator identification data and information to the lock controller to provide programming updates to the machine and create a record of the date, time and by whom the machine has been accessed. After the transfer of machine data and programming and operation identification data between the key controller and lock controller, the lock controller sends an approximately 40 to 50 volt signal or power pulse, as indicated at step 139, to the solenoid for the mechanical locking assembly. This power signal causes the plunger 117 (FIG. 4) of the solenoid to be extended and engage and pivot the lever 118 downwardly.

The pivoting of the lever 118 causes the locking bolt 106 to be urged downwardly against the force of the biasing element or spring 111 so as to release the handle assembly from its engaged, locked position within the cavity of the outer lock housing 81. In response, the handle body and grip portion 94 are urged outwardly away from the outer lock housing and front surface of the outer door by the compression spring 103 bearing against the second or rear end 93 of the handle body 91 to place the grip and handle body in an extended, nonengaging position displaced from the outer lock housing and front surface of the outer door to enable rotation of the handle body. The operator then rotates the handle body to disengage the distal end 101 of the post 98 from the latch elements 78 of the first or inner lock housing 75 to thus disengage the lock assembly and enable the machine doors to be opened as indicated at 141. If a post type latching assembly is used, typically the locking element will be mounted in the inner lock housing and will be disengaged from the post by actuation of the solenoid so that the post is released from engagement with the inner lock housing to allow the door to be opened without requiring further manipulation or rotation by the operator.

Once the machine doors have been opened, the operator can restock the machine as indicated at 142 or perform any needed servicing of the machine components. As indicated at 143, the operator thereafter enters data into the key controller as to the types and amount of product stocked in the machine so as to provide a record of how much product was previously used or dispensed by the machine to check against the machine receipts and for inventory control. As shown at 144, the operator further checks to see if the machine is in operating condition, and if not, he or she enters a work or repair order, shown at 146 to the key controller. After the work order has been entered into the key controller or if no repair/work order is required, the operator closes the doors and re-engages the mechanical locking assembly as a final step 147.

After the operator has completed all of his service calls for the day, week or other time period, the information recorded in the hand held key controller from each machine services by the operator is downloaded to the central processor or server unit 63 as indicated at FIG. 6B. For example, information as to the machines serviced and the amount of inventory dispensed into each machine is downloaded to the central computer unit and can be checked against the beginning and ending inventory sent out with that particular operator. In addition, any work or repair orders and machine specific information, such as who had accessed the machines, when such access was made, as well as information regarding how long each service call took for a particular machine or set of machines also can be downloaded and reported. This information in turn can be used to run reports such as security, sales and/or service reports to enable closer monitoring and more detailed information to be generated regarding how much product is being dispensed from certain machines or groups of machines so as to indicate the frequency at which such machines need to be serviced and average service times for such machines for better or more efficient planning of service routes and calls.

The present invention thus provides more enhanced security of enclosures such as vending machines, ATMs or similar types of enclosures by providing an electronically operated latching assembly through which access to the machines/enclosures can be tightly controlled, and which further enables information regarding the servicing of such machines/enclosures to be monitored and reported to enable businesses to service such machines/enclosures more efficiently and to reduce or minimize down time and losses.

It will be understood by those skilled in the art that while the foregoing invention has been disclosed with reference to preferred embodiments or features, various modifications, changes and additions can be made to the foregoing invention, without departing from the spirit and scope of the invention as set forth in the following claims.

What is claimed is:

1. A latching system for a machine comprising:

a machine controller;

a locking assembly mounted to the machine and comprising an actuator and lock for securing the machine, and a lock controller mounted to the machine operably connected to said actuator;

a data/power link mounted to the machine and connected to said lock controller; and, a portable key controller comprising a portable power source and a transmitter, wherein said portable key controller transmits in a contact-free manner power and data to said data/power link, wherein the data comprises programming instructions for the machine, said data/power link transmits the data and the power to said lock controller and wherein said lock controller transmits the data to said machine controller and activates said actuator for unlocking the machine.

2. The latching system of claim 1, wherein said lock controller transmits machine data to said data/power link and said data/power link transmits the machine data to said portable key controller.

3. The latching system of claim 1, wherein said portable key controller further comprises a display.

4. The latching system of claim 1, wherein said portable key controller further comprises a key pad.

5. The latching system of claim 3, wherein said display comprises a touch screen.

6. The latching system of claim 1, further comprising a central processing unit.

7. The latching system of claim 6, wherein the programming instructions are transmitted from said central processing unit to said portable key controller.

8. The latching system of claim 7, wherein the programming instructions are for setting of machine operating parameters.

9. The latching system of claim 2, further comprising a central processing unit operably connected to said portable key controller.

10. The latching system of claim 9, wherein said portable key controller transmits received machine data to said central processing unit.

11. The latching system of claim 1, wherein said locking assembly further comprises a post and a lock housing defining a longitudinal passage that receives a portion of said post in locking engagement therewith to secure a door of the machine.

12. The latching system of claim 11, wherein said actuator disengages said post from said locking engagement within said housing when said actuator is activated by said lock controller.

13. The latching system of claim 1, wherein said portable key controller further comprises an inductive powered transceiver and said data/link comprises an RF data link.

14. The latching system of claim 1, wherein said portable key controller further comprises an inductive powered infrared transceiver and said data/link comprises an infrared data link.

15. The latching system of claim 1, wherein said portable key controller comprises an inductive coupling for transmitting power and data from said portable key controller to an inductive coupling of said data/power link through a non-conductive surface of said machine via inductive transfer.

16. The latching system of claim 1, wherein the machine is selected from the group consisting of service oriented machines.

17. The latching system of claim 1, further comprising a secondary control access mounted to said machine and operably connected to said lock controller, wherein said secondary control access receives power and data in a contact-free manner from said portable key controller and transmits the power and data to said lock controller.

18. The latching system of claim 1, wherein the data transmitted to said lock controller comprises program instructions.

19. The latching system of claim 1, wherein the program instructions comprise control instructions for the control parameters of the machine.

20. The latching system of claim 1, wherein said lock controller and said portable key controller include software adapted to record access information transmitted by said lock controller in response to activation of said actuator and to restrict access to the machine upon receipt of nonconforming access information.

21. A latching system for an enclosure comprising:

a locking assembly mounted to an enclosure and comprising an actuator connected to a lock that secures a door of said enclosure;

a lock controller mounted to said enclosure operably connected to said actuator;

a data/power link mounted to said enclosure and connected to said lock controller; and, a portable key controller comprising a display, an input mechanism for keying data into said portable key controller and a portable power source, wherein said portable key controller transmits in a contact-free manner power and operator information to said lock controller through said data/power link and receives identification information through said data/power link from said lock controller, and wherein said lock controller activates said actuator upon receipt of the power to disengage said lock.

22. The latching system of claim 21, further comprising a central processing unit operably connected to said portable key controller.

23. The latching system of claim 21, wherein said central processing unit transmits the operator information to said portable key controller.

24. The latching system of claim 22, wherein said portable key controller transmits the identification information to said central processing unit.

25. The latching system of claim 21, further comprising a secondary control access mounted to said enclosure and operably connected to said lock controller, wherein said secondary control access receives the power and the operator data in a contact-free manner from said portable key controller and transmits the power and the operator data to said lock controller.

26. The latching system of claim 21, wherein said input mechanism comprises a key pad.

27. The latching system of claim 21, wherein said display comprises a touch screen.

28. The latching system of claim 21, wherein said portable key controller further comprises an inductive powered RF transceiver and said data/link comprises an RF data link.

29. The latching system of claim 21, wherein said portable key controller further comprises an inductive powered infrared transceiver and said data/link comprises an infrared data link.

* * * * *